United States Patent [19]

Bockstiegel et al.

[11] 4,048,119

[45] Sept. 13, 1977

[54] HEATING ELEMENT COMPOSITION AND METHOD FOR PREPARING TUBE FILLINGS OF HIGH ELECTRICAL RESISTANCE FROM FUSED MAGNESIUM OXIDE FOR TUBULAR ELECTRIC HEATING ELEMENTS

[75] Inventors: Gerd-Edzard Bockstiegel, Troisdorf-Sieglar; Manfred Neidhardt, Siegburg; Gerhard Rehfeld, Aachen, all of Germany

[73] Assignee: Dynamit Nobel Aktiengesellschaft, Troisdorf, Germany

[21] Appl. No.: 691,956

[22] Filed: June 1, 1976

[30] Foreign Application Priority Data

June 7, 1975 Germany ..... 2525441

[51] Int. Cl.[2] ..... H01B 1/08

[52] U.S. Cl. ..... 252/521; 252/518; 252/63.2; 252/63.5

[58] Field of Search ..... 252/518, 521, 63.2, 252/63.5; 106/73.4

[56] References Cited

U.S. PATENT DOCUMENTS

| | | | |
|---|---|---|---|
| 3,380,838 | 4/1968 | Sack | 106/73.4 X |
| 3,583,919 | 6/1971 | Balint et al. | 106/58 X |
| 3,592,771 | 7/1971 | Vedder et al. | 106/58 X |
| 3,621,204 | 11/1971 | Neidhardt et al. | 252/63.5 X |
| 3,622,755 | 11/1971 | Vedder | 252/63.2 X |

*Primary Examiner*—Benjamin R. Padgett
*Assistant Examiner*—E. Suzanne Parr
*Attorney, Agent, or Firm*—Burgess, Dinklage & Sprung

[57] ABSTRACT

An electrical heating element composition comprising crystals of fused magnesium oxide improved by the inclusion of 0.05 to 5% by weight, based on the weight of said fused magnesium oxide, of an additive composition which has excellent lubricating properties in respect of the magnesium oxide crystals and reacts at 800° to 1050° C with active conductivity centers at the surface of one or more adjacent magnesium oxide crystals; an improvement in the preparation of an electrical heating element wherein a granular fused magnesium oxide composition is subjected to mechanical shaping and calcination which comprises employing as the electrical heating element composition a composition comprising crystals of fused magnesium oxide and 0.05 to 5% by weight, based on the weight of said fused magnesium oxide, of an additive composition which has excellent lubricating properties in respect of the magnesium oxide crystals and reacts at 800° to 1050° C with the active conductivity centers at the surface of one or more adjacent magnesium oxide crystals.

16 Claims, No Drawings

HEATING ELEMENT COMPOSITION AND METHOD FOR PREPARING TUBE FILLINGS OF HIGH ELECTRICAL RESISTANCE FROM FUSED MAGNESIUM OXIDE FOR TUBULAR ELECTRIC HEATING ELEMENTS

BACKGROUND OF THE INVENTION

1. Field of the Invention

This invention relates to a new and improved electrical heating element composition. More especially this invention relates to an electrical heating element composition based upon fused magnesium oxide containing as an additive therefor a composition with has excellent lubricating properties in respect of crystals of the fused magnesium oxide and which reacts at 800° to 1050° C with active conductivity centers at the surface of one or more adjacent magnesium oxide crystals. More especially this invention is directed to the preparation of improved electrical insulating materials employed in the tubular heating elements wherein there is present in the electrical insulating material, as an additive, a minor percentage of an additive composition which reacts with the conductivity centers of a fused magnesium oxide base whereby to decrease the electrical conductivity of the heating element and concomitantly improve its resistance characteristics. More especially this invention is directed to an electrical heating element composition containing as an additive a mineralogical composition within the $MgO—SiO_2—Al_2O_3$ system, especially for a composition containing a major amount of components which are amorphous or radioamorphous.

2. Discussion of the Prior Art

Fused magnesium oxide is used as an electrical insulating material in tubular heating elements between the voltage-carrying heating coil and the tubular jacket. Tubular heating elements of this kind are used in the electrical heating and household appliance industries. The fused magnesium oxide has approximately the following chemical composition:

MgO: 94 - 98 weight percent
$SiO_2$: 1.0 - 3.5 weight percent
CaO: 0.5 - 2.0 weight percent
$Al_2O_3$: 0.02 - 0.25 weight percent
$Fe_2O_3$: 0.01 - 0.1 weight percent
NiO: 0.01 - 0.03 weight percent In addition, traces of $So_3$, Cl, $B_2O_3$, $TiO_2$, $Na_2O$ or $K_2O$ are present.

The grain size composition of the commercial mixtures of fused and granulated magnesium oxide ranges as a rule between 0.01 and 0.4 mm. The electrical resistance of the insulating composition prepared therefrom differs greatly. Particularly when the insulating material is exposed to temperatures of over 800° C, fluctuations of the electrical resistance take place. The cause of this lies in the different concentrations of the conductivity centers, as they are called in the MgO insulator.

In contrast to the ideal insulator, which theoretically has the ideal crystal lattice, i.e., a lattice having no dislocations, no electron vacancies (electron "holes") and no excess electrons, every insulator that can be made in practice has a more or less high concentration of lattice disclocations, holes and excess electrons, and this is responsible for higher or lower electrical conductivity. This concentration of defects, generally known as "imperfection", is distributed in the interior and on the surface of the crystal (cf. Fritz Rőhm, "Festkőrperphysik" and W. Finkelnburg, "Einfűhrung in die Atomphysik").

It is known that the concentration of imperfections can be reduced by calcining processes to an equilibrium for the specific temperature, due to the thermal vibration of the atoms in the lattice that is associated with the calcining. This knowledge has long been applied in the preparation of electrically fused magnesium oxide as an insulator. This calcination process usually follows a comminuting process performed on the raw magnesium oxide heating coil composition.

In the production of tubular heating elements, the magnesium oxide filling is again subjected to severe stress by a compressing process — hammering, rolling and/or pressing. Due to lattice tension in the crystal grain, at the surface thereof, or due to grain destruction as a result of the mechanical stress produced by the compression, disturbances are again produced in the interior and/or on the surface of the crystals, which again result in an increase in electrical conductivity.

In practice, the quality of tubular heating elements is judged on the basis of the measured leakage currents, which are inversely proportional to the electrical resistance. These leakage currents vary in different insulating materials in spite of similar or identical composition. In particular, when a specific surface dissipation of, for example, 10 Watts per square centimeter of the surface of the element is reached, leakage currents are obtained under the test conditions stated below of between 6 mA and about 40 mA. In tubular heating elements, however, the lowest possible electrical conductivity is desired, i.e., a high electrical resistance at high temperatures and high specific electrical dissipation.

German Pat. No. 1,921,789 discloses fillings for tubular heating elements, which consist of granulated, fused MgO and the addition of sintered magnesium silicates, magnesium oxide, or mixtures thereof, the grains of the additive consisting mainly or virtually entirely of a plurality of individual crystals under 10 microns. Such fillings have an improved electrical resistance in comparison with other known fillings. It is a disadvantage of these fillings based on German Pat. No. 1,921,789, however, that they have a comparatively high electrical resistance at specific disipations of 7 to less than 9 Watts per $cm^2$, but at dissipations of 9 to 10 $W/cm^2$, they are only partially satisfactory in practice.

Accordingly, it is an object of the present invention to provide filling compositions performing tubular electrical insulation elements which have improved electrical resistance both at high specific dissipations of 10 $W/cm^2$ and that the specific dissipation encountered in practice was generally less than 10 $W/cm^2$. More especially, it is an object of the present invention to provide an improved electrical heating element composition whereby there is a marked reduction in the electrical conductivity of the resultant tubular element coupled with an improvement in the electrical resistance. More especially it has become an object of the present invention to provide an electrical heating element composition which functions to improve the respective lubricity characteristics of crystals or granules of fused magnesium oxide heating element components which will, in addition thereto, react with the conductivity centers thereof to reduce the electrical conductivity of the heating element, especially a composition which will react with the fused magnesium oxide of the electrical heating element composition at low temperatures, say, at 800–1050° C to provide a composition having overall improved electrical resistance.

SUMMARY OF THE INVENTION

The long felt desideratum in this art is solved by providing in a granulated fused magnesium oxide heating element composition an additive which prevents the destruction of the magnesium oxide crystals during the shaping process, e.g., compressing process, by lubricating the respective crystals of fused magnesium oxide while, at the same time, providing high topochemical reactivity. The high topochemical reactivity is such that at relatively low temperatures, such as those employed in the heating of tubular heating elements prior to bending, e.g., 30 minutes of heating at 800° to 1050° C, there is a reaction with the active conductivity centers (impurity spots) at the surface of one or more adjacent magnesium oxide crystals. The reaction with these conductivity centers serves to neutralize the conductivity centers thereby decreasing the electrical conductivity of the resultant heating element while at the same time increasing the electrical insulating properties and rendering the same more efficient from an electrical heating element component point of view.

In accordance with the present invention there is provided an improvement in an electrical heating element composition which contains crystals of fused magnesium oxide, the improvement including in the composition composed of crystals of fused magnesium oxide, 0.05 to 5% by weight, based upon the weight of magnesium oxide, of an additive composition which has excellent lubricating properties in respect of the magnesium oxide crystals and reacts at 800° to 1050° C with active conductivity centers at the surface of one or more adjacent magnesium oxide crystals.

In accordance with the present invention it has been discovered that by employing certain components such as a magnesium complex, particularly the magnesium complex of the mineralogical composition within the $MgO—SiO_2—Al_2O_3$ system, that those residual centers of conductivity within a known fused magnesium oxide composition of an electrical heating element can be neutralized to markedly reduce the conductivity of the heating element while at the same time imparting the same improved electrical insulating characteristics. It has been discovered that by the inclusion of, say, an alumina-silica-magnesia composition in a minor amount in a fused magnesium oxide heating element composition that there is a marked reduction in the electrical conductivity of the composition, particularly following the usual mechanical shapening steps and subsequent calcination. While not wishing to be bound by any theory it is believed that the components of the mineralogical composition of $MgO—SiO_2—Al_2O_3$ react with conductivity centers of the fused magnesium oxide formed during the shaping of the fused magnesium oxide or the resultant condensation. In any event there is a marked reduction in electrical conductivity coupled with a marked increase in thermal conductivity for the resultant tubular heating element.

Additives which are suitable in accordance with the invention are those which easily yield electrons to the magnesium oxide lattice to fill electron holes and to accept excess electrons easily from other places in the lattice, so that in this manner, too, the concentration of imperfections will be reduced, and with it the electrical conductivity. It has furthermore been found that those materials especially are suited for this purpose which have been prepared by sintering or fusion, followed by quenching, and whose grains have an amorphous phase as well as microcrystalline to cryptocrystalline portions, the crystal size in the crystalline portion not exceeding a maximum of 10 microns. Certain magnesium compounds of complex composition have proven to be especially suitable.

The invention is therefore also directed to a method for the preparation of filling materials for electrical heating elements whose filling has an improved electrical resistance and consists of granulated fused magnesium oxide and an additive consisting of a magnesium compound of complex composition, this method being characterized in that a sintered additive or a fused and quenched additive is added to the magnesium oxide prior to charging the tube with it, the mineralogical composition of said additive being within the $MgO—SiO_2—Al_2O_3$ system and its grains consisting of amorphous phases and micro- to cryptocrystalline phases, and the crystal size in the crystalline portion not exceeding a maximum of 10 microns.

DESCRIPTION OF PREFERRED EMBODIMENTS

The magnesium compound which is to be added in accordance with the invention is produced by sintering or by melting and quenching mixtures of preferably synthetic raw materials such as technical alumina of approximately 99% $SiO_2$ and magnesium carbonate or magnesium oxide of approximately 98% MgO, and the like. Naturally occurring raw materials can be used, if desired, if they have the necessary purity.

The raw materials used are to contain no impurities or only traces of impurities having an ionic lattice and hence an ionic conductivity, such as alkaline metal oxides — $Na_2O$ or $K_2O$, for example, halides, sulfates such as those of alkaline earth metals, and the like. Alkaline earth metal oxides other than MgO, oxides of transitional elements such as FeO, $Fe_2O_3$, $TiO_2$, and the like, can be contained in an amount equal to or less than 2% by weight of the sum of the individual components of the raw materials used, without any indication of any unwanted effect.

Those additives are preferred as magnesium compounds, in accordance with the invention, whose chemical composition falls approximately within the following limits:

$Al_2O_3$ 10–35, preferably 12 to 26, especially 22 weight percent,
$SiO_2$ 40–75, preferably 55 to 75, especially 68 weight percent,
MgO 5–25, preferably 7 to 20, especially 10 weight percent.

The amount of additive to be added in accordance with the invention is from 0.05 to 5 weight percent, preferably 2 weight percent.

The sintered or melted and quenched magnesium contains, in its mineralogical composition, varying amounts of a variety of magnesium silicates and magnesium aluminum silicates as well as a high content of radioamorphous to glassy substance. The mineralogical composition of the individual grains can vary as a result of the crushing process. The individual grains can differ from one another also in regard to their physical state. This means that the individual grains can contain more or less great proportions of amorphous or microcrystalline to cryptocrystalline phases.

The distribution of the various phases within a single grain is irregular in the case of the sintered additive. For example, within a range of about 10 to 20 microns there may be micro- to cryptocrystalline magnesium silicates or magnesium silicates in addition to radioamorphous transition phases of a composition containing larger or smaller amounts of $SiO_2$, an amorphous, optically isotropic material being additionally observable among these optically anisotropic compounds. In the case of the melted and quenched additive, the micro- to cryptocrystalline phases in the individual grain have a spheroidal to cloud-like distribution within an amorphous, optically isotropic ground mass, which, however, can also have a certain amount of tensional birefringence.

Preferred in accordance with the invention are additives in which, with respect to the sum of the individual grains, the proportion of the combined amorphous and radioamorphous phases amounts to between 50 and 95%, preferably between 65 and 80%, by weight.

In the preparation of the material to be added in accordance with the invention, the sintering or quenching conditions are so chosen that the additive will have such a phase composition and physical state that, on the one hand, it acts as a lubricant in the compressing process of hammering, rolling and/or pressing, for example, while on the other hand it has the property of reacting with the imperfections on the surface of the magnesium oxide grain under the relatively low-temperature conditions encountered in practice, such as those which occur, for example, when the tubular heating elements are bright annealed after the compressing process and prior to bending (approximately 30 minutes of heating at 800° to 1050° C).

In the case of mixtures of alumina ($Al_2O_3$), silica ($SiO_2$) and magnesium carbonate, sintering temperatures between 1100° C and 1400° C, preferably 1250° C, are used, with sintering times of 30 minutes to 3 hours. It is desirable that the sintering be performed in an oxidizing atmosphere, e.g., air. The material to be sintered should preferably be of a grain size of from less than 2 microns to a maximum of 10 microns.

After sintering, the material is crushed to a grain size smaller than 0.4 mm, preferably smaller than 0.1 mm. The optimum sintering conditions for other raw materials or mixtures of raw materials are determined, if desired, on the basis of preliminary tests. The same applies to the additives of the invention which are prepared by melting and quenching. Here, too, the optimum conditions can be determined by preliminary testing.

The molten raw material mixtures intended for the additives of the invention are best cast in steel or graphite molds. Conventional methods can be used for quenching the molten material. For example, the melt can be cast in small metal molds of a capacity, for example, of 20 kg, or in molds filled with metallic cooling bodies. The metallic cooling bodies can be, for example, iron balls, or metal plates set on edge on the bottom of the mold and spaced apart from one another. After the metallic cooling bodies have been removed, the fragments, after a coarse crushing if desired, can be ground to a grain size smaller than 0.4 mm, and preferably smaller than 0.1 mm.

The conditions which will be described in the Examples can serve as a guide for the quenching of melts of a chemical composition of 10 to 35 weight percent $Al_2O_3$, 40 to 75 weight percent $SiO_2$ and 5 to 25 weight percent MgO.

The additives of the invention surprisingly prevent substantially the destruction of the grain of the fused magnesium oxide in the compressing process in the manufacture of the tubular heating elements, even when additives are used which contain a comparatively low proportion of microcrystalline to cryptocrystalline material (e.g., only 20 weight percent). This is surprising, since in view of German Pat. No. 1,921,789, it was to be assumed that grain destruction can be prevented only if the individual grains of the additive consist wholly or largely of a plurality of individual crystals under 10 microns.

The additives of the invention apparently act as lubricants between the electromagnesia grains when the tubular heating elements are compressed. Along with the diminished grain destruction upon compression, increased thermal conductivity is achieved by a better intermeshing of the grains in the mass. This improved compression combined with higher thermal conductivity result in a lower temperature gradient from the heating coil to the tubular jacket. The result of this is a lower average temperature in the insulation material for the same surface temperature, and, due to the temperature-dependence of the electrical conductivity, a reduction of the latter.

On account of the phase composition, or on the basis of the amorphous plus micro- to cryptocrystalline structure, the additives of the invention have, in addition to their good lubricating properties, an extremely high topochemical reactivity, so that, under the relatively low-temperature conditions encountered in practice, such as those under which the bright annealing of the tubular heating elements is performed prior to bending, they react with the imperfections on the surface of one or more adjacent magnesium oxide grains. In practice, temperatures of 800° to 1050° C are applied for up to 30 minutes.

Furthermore, in this annealing process, complex compounds, e.g., binary, ternary or quaternary compounds, are formed, and they can consist mainly of MgO, $Al_2O_3$ and $SiO_2$, and additionally of FeO, $Fe_2O_3$ and CaO.

Consequently, ions such as $Fe^{++}$ or $Fe^{+++}$ or $Ca^{++}$, which in some cases can contribute considerably to the ionic conductivity of the insulator, are fixed in ternary and quaternary compounds which are relatively resistant to diffusion, and which, being locally restricted, can have no negative influence on the overall conductivity of the insulating composition.

The composition of these compounds can be determined semiquantitatively by means of the electronic microprobe. However, considerable variations occur due to the locally very changeable differences in concentration.

By X-ray diffraction analysis such compounds are not reliably identifiable on account of their complex composition on the one hand and, on the other hand, the very small proportions in which they are present.

The radioamorphous or glassy portion of the additives is necessary for the virtually unhampered transfer of electrons to equalize holes and excess electrons.

In order to more fully illustrate the nature of the invention and the manner of practicing the same the following examples are presented.

EXAMPLES

In the following examples, a comparison is made of the leakage currents which were measured on test specimens of commercial products and products made in accordance with the invention, and which serve as a measure of the electrical insulating quality of the fused magnesium oxide.

The measurement of the leakage currents, which are inversely proportional to the electrical resistances, was performed on high-quality steel tubing such as is used in the electrical heating art. The tubes had the following dimensions:

Length: 500 mm (before compression)
Diameter: 10 mm (before compression)
Wall thickness: 0.75 mm (before compression)

After the tubes had been filled and closed, they were reduced to a diameter of 8.5 mm by circular hammering. The heating coils had a diameter of 3 mm and a wire diameter of 0.3 mm. The test voltage between the heating coil and the tubular jacket was 500 V. The heating voltage applied was between 170 and 240 V, according to the specific wattage dissipation.

Before the measurement, the test heating element was heated to an average temperature of 900° C, as it would be in practice in the bright annealing operation, for approximately 20 minutes.

Example 1

A mixture of 20 weight-parts of tabular alumina (99.2 Wt.-% $Al_2O_3$, remainder: traces of $Na_2O$, max. 0.2% loss through heating to incandescence), grain size 70% smaller than 10 microns; 61.8 weight-parts of amorphous silica (Aerosil$^R$, 99.6 wt.-% $SiO_2$, remainder: traces of $Al_2O_3$, $Fe_2O_3$, CaO, $K_2O$), grain size 70% smaller than 2 microns, and 18.2 weight-parts of magnesium carbonate (provenance: Greece, purity: at least 49 wt.-% MgO, max. 1.1 wt.-% $SiO_2$, 0.6 wt.-% CaO, traces of $Fe_2O_3$, $TiO_2$, remainder $CO_2$), grain size approximately 70% smaller than 10 microns, was sintered under oxidizing conditions for 50 minutes at 1250° C. Then the sintered block was crushed to a grain size of 0 to 100 microns.

2%, by weight, of the granulated material was added to each of commercial electromagnesia samples of different qualities A to E. The granulated material had the following composition:

Approx. 22 wt.-% $Al_2O_3$
Approx. 68 wt.-% $SiO_2$
Approx. 10 wt.-% MgO

The amorphous content amounted to about 76 wt.-%; the remainder was substantially micro- to cryptocrystalline (smaller than 10 microns).

The leakage currents were measured 15 minutes after the specific dissipation specified was reached.

TABLE I

| Specific dissipation: | 7 | 8 | 9 | 10 | Watts/cm² |
|---|---|---|---|---|---|
| A without additive | 1.59 | 3.28 | 6.48 | 14.6 | mA |
| with 2 wt.-% | 0.92 | 1.90 | 2.92 | 4.82 | mA |
| B without additive | 2.05 | 4.10 | 8.65 | 16.8 | mA |
| with 2 wt.-% | 0.96 | 1.88 | 3.20 | 5.3 | mA |
| C without additive | 1.23 | 3.80 | 9.15 | 28.9 | mA |
| with 2 wt.-% | 0.65 | 1.54 | 3.60 | 5.8 | mA |
| D without additive | 0.96 | 2.05 | 4.48 | 12.2 | mA |
| with 2 wt.-% | 0.38 | 0.82 | 1.34 | 3.64 | mA |

TABLE I-continued

| Specific dissipation: | 7 | 8 | 9 | 10 | Watts/cm² |
|---|---|---|---|---|---|
| E without additive | 0.82 | 1.67 | 2.35 | 6.87 | mA |
| with 2 wt.-% | 0.30 | 0.54 | 0.92 | 2.87 | mA |

Example 2

A mixture of the same composition as in Example 1 was melted in the arc furnace under reducing conditions. The melt was cast in molds filled with iron balls, and after cooling, and removing the balls with a magnetic separator, it was crushed to a grain size of 0 to 100 microns. The mold had the following dimensions: 500–700 mm diameter, upwardly tapering steel mold, wall thickness 100 mm, height 700 mm. The balls had a diameter of 60 mm. The weight ratio of the ball charge to the melt was 575 kg of balls to 160 kg of melt.

The leakage currents were measured as in Example 1, 2 wt.-% of the granulated material being added to commercial electromagnesia samples as in Example 1.

TABLE II

| Specific dissipation: | 7 | 8 | 9 | 10 | Watts/cm² |
|---|---|---|---|---|---|
| A without additive | 1.59 | 3.28 | 6.48 | 14.6 | mA |
| with 2 wt.-% | 1.08 | 1.96 | 3.20 | 6.9 | mA |
| B without additive | 2.05 | 4.10 | 8.65 | 16.8 | mA |
| with 2 wt.-% | 1.24 | 2.05 | 3.80 | 7.2 | mA |
| C without additive | 1.23 | 3.80 | 9.15 | 28.9 | mA |
| with 2 wt.-% | 0.82 | 1.76 | 3.90 | 12.3 | mA |
| D without additive | 0.96 | 2.05 | 4.48 | 12.2 | mA |
| with 2 wt.-% | 0.67 | 1.43 | 2.16 | 5.8 | mA |
| E without additive | 0.82 | 1.67 | 2.35 | 6.87 | mA |
| with 2 wt.-% | 0.58 | 0.87 | 1.05 | 3.84 | mA |

Comparative Example 1

For purposes of comparison, the same mixture as in Example 1 was sintered except that the sintering temperature was 1250° C and the sintering time was 600 minutes. The resulting individual grains (grain size same as in Example 1) contained only small percentages of amorphous phase (approx. 15 wt.-%). They consisted mainly of a great number of individual crystals under 10 microns. As in Example 1, 2 wt.-% of the granulated material was added to commercial samples of electromagnesia of various qualities A to E, and the test heating elements were treated in the same manner as described above. The leakage currents were measured as previously described. In the following table the found values are compared to the values obtained in accordance with the invention. The results clearly show the effect that is accomplished by the invention.

TABLE III

| Specific dissipation: | 7 | 8 | 9 | 10 | W/cm² |
|---|---|---|---|---|---|
| A) Without additive | 1.59 | 3.28 | 6.48 | 14.6 | mA |
| 2% additive of Example 1 | 0.92 | 1.90 | 2.92 | 4.82 | mA |
| 2% additive of Comp. Ex. 1 | 1.10 | 2.30 | 3.25 | 5.4 | mA |
| B) Without additive | 2.05 | 4.10 | 8.65 | 16.8 | mA |
| 2% additive of Example 1 | 0.96 | 1.88 | 3.20 | 5.3 | mA |
| 2% additive of Comp. Ex. 1 | 1.30 | 2.10 | 4.0 | 7.6 | mA |
| C) Without additive | 1.23 | 3.80 | 9.15 | 28.9 | mA |
| 2% additive of Example 1 | 0.65 | 1.54 | 3.60 | 5.8 | mA |
| 2% additive of Comp. Ex. 1 | 0.85 | 1.92 | 4.2 | 13.8 | mA |
| D) Without additive | 0.96 | 2.05 | 4.48 | 12.2 | mA |
| 2% additive of Example 1 | 0.38 | 0.82 | 1.34 | 3.64 | mA |
| 2% additive of Comp. Ex. 1 | 0.75 | 1.45 | 2.25 | 6.5 | mA |
| E) Without additive | 0.82 | 1.67 | 2.35 | 6.87 | mA |
| 2% additive of Example 1 | 0.30 | 0.54 | 0.92 | 2.87 | mA |
| 2% additive of Comp. Ex. 1 | 0.62 | 0.95 | 1.15 | 4.05 | mA |

Comparative Example 2

Sintered magnesium silicate (enstatite) consisting almost entirely of a great number of individual crystals (cf. Examples 1 to 5 of German Pat. No. 1,921,789) was added in amounts of 2 wt.-% (grain size 0 to 100 microns) to the electromagnesia samples used in Examples 1 and 2 of the present invention. For comparison, 2 wt.-% (grain size 0 to 100 microns) of the magnesium compound prepared in Example 1 (chemical composition approx. 22 wt.-% $Al_2O_3$, approximately 68 wt.-% $SiO_2$, and approximately 10 wt.-% MgO) was added to the same electromagnesia samples.

The micro- to cryptocrystalline content of the material that was added amounted to about 24 wt.-%.

After the circular hammering of the filled tubes, the fillings were tested to see if any grain destruction had taken place, but no difference could be observed. Another series of tests was performed and the leakage currents were compared. The following table reflects the superiority of the tube fillings used in accordance with the present invention over the tubular fillings of German Pat. No. 1,921,789.

TABLE IV

| Specific Surface Dissipation | 7 | 8 | 9 | 10 | W/cm² |
|---|---|---|---|---|---|
| A) Without additive | 1.59 | 3.28 | 6.48 | 14.6 | mA |
| 2% Example 1 additive | 0.92 | 1.90 | 2.92 | 4.82 | mA |
| 2% prior-art additive* | 1.15 | 2.40 | 3.50 | 6.2 | mA |
| B) Without additive | 2.05 | 4.10 | 8.65 | 16.8 | mA |
| 2% Example 1 additive | 0.96 | 1.88 | 3.20 | 5.3 | mA |
| 2% prior-art additive* | 1.40 | 2.25 | 4.3 | 8.4 | mA |
| C) Without additive | 1.23 | 3.80 | 9.15 | 28.9 | mA |
| 2% Example 1 additive | 0.65 | 1.54 | 3.60 | 5.8 | mA |
| 2% prior-art additive* | 0.90 | 2.05 | 4.35 | 15.7 | mA |
| D) Without additive | 0.96 | 2.05 | 4.48 | 12.2 | mA |
| 2% Example 1 additive | 0.38 | 0.82 | 1.34 | 3.64 | mA |
| 2% prior-art additive* | 0.70 | 1.45 | 2.37 | 7.2 | mA |
| E) Without additive | 0.82 | 1.67 | 2.35 | 6.87 | mA |
| 2% Example 1 additive | 0.30 | 0.54 | 0.92 | 2.87 | mA |
| 2% prior-art additive* | 0.68 | 1.05 | 1.35 | 4.20 | mA |

*Additive of German Pat. 1.921.789

What is claimed is:

1. In an electrical heating element composition comprising crystals of a fused magnesium oxide, the improvement for reducing electrical conductivity of said composition which comprises 0.05 to 5% by weight, based on the amount of said fused magnesium oxide, of a granular magnesium additive composition having a mineralogical composition within the $MgO—SiO_2—Al_2O_3$ system, said additive composition consisting essentially of amorphous phases and micro- to cryptocrystalline phases, the crystal sizes of the crystalline portions not exceeding 10 microns, said additive having excellent lubricating properties in respect of said magnesium oxide crystals and reacting therewith at 800° to 1050° C with active conductivity centers at the surface of one or more adjacent magnesium oxide crystals.

2. An electrical heating element composition according to claim 1 wherein said magnesium complex has a composition within the following range:

$Al_2O_3$ — 10 to 35 weight percent
$SiO_2$ — 40 to 75 weight percent
MgO — 5 to 25 weight percent

3. An electrical heating element composition according to claim 1 wherein said magnesium complex has a composition within the following range:

$Al_2O_3$ — 12 to 26 weight percent
$SiO_2$ — 55 to 75 weight percent
MgO — 7 to 20 weight percent

4. An electrical heating element composition according to claim 1 wherein said magnesium complex has a composition as follows:

$Al_2O_3$ — 22 weight percent
$SiO_2$ — 68 weight percent
MgO — 10 weight percent

5. An electrical heating element composition according to claim 2 wherein said magnesium complex comprises grains of amorphous and/or radioamorphous phases and the combined amorphous and radioamorphous phases amounts to between 50 and 95 percent by weight of the additive composition.

6. An electrical heating element composition according to claim 2 wherein said magnesium complex comprises grains of amorphous and/or radioamorphous phases and the combined amorphous and radioamorphous phases amounts to between 65 and 80 percent by weight of the additive composition.

7. An electrical heating element composition according to claim 2 wherein the additive composition consists essentially of amorphous phases.

8. An electrical heating element composition according to claim 2 wherein said MgO is supplied by magnesium carbonate.

9. An electrical heating element composition according to claim 2 wherein said magnesium complex is one obtained by sintering the alumina, silica and magnesium carbonate at temperatures between 1100° C and 1400° C for 30 minutes to 3 hours.

10. An electrical heating element composition according to claim 9 wherein said sintering is performed in an oxidizing atmosphere.

11. An electrical heating element composition according to claim 10 wherein the material which is subjected to sintering has a grain size less than 10 microns.

12. An electrical heating element composition according to claim 2 wherein the magnesium complex has a particle size of less than 0.4 mm.

13. An electrical heating element composition according to claim 12 wherein the magnesium complex has a particle size of less than 0.1 mm.

14. An electrical heating element composition according to claim 2 wherein said additive composition is present in an amount of 2% by weight based on the weight of the heating element composition.

15. In the process for preparing an electrical heating element wherein fused crystals of a magnesium oxide composition are subjected to compressing processes and thereafter subjected to calcination, the improvement which comprises employing as the electrical heating element the composition of claim 1.

16. An electrical heating element composition according to claim 1 wherein the additive composition further contains alkaline earth metal oxides and oxides of transition elements in a combined amount equal to or less than 2 percent by weight.

* * * * *